United States Patent [19]

Coad et al.

[11] Patent Number: 4,541,227

[45] Date of Patent: Sep. 17, 1985

[54] APPARATUS FOR AUTOMATICALLY PACKING ARTICLES IN A BALE BAG

[75] Inventors: Edward F. Coad; Carol G. Laird, both of Topeka, Kans.

[73] Assignee: General Foods Corporation, White Plains, N.Y.

[21] Appl. No.: 520,394

[22] Filed: Aug. 4, 1983

[51] Int. Cl.[4] ..... B65B 57/20

[52] U.S. Cl. ..... 53/500; 53/55; 53/386; 53/531

[58] Field of Search ..... 53/500, 495, 498, 493, 53/67, 505, 55, 540, 531, 386, 384

[56] References Cited

U.S. PATENT DOCUMENTS

| | | | |
|---|---|---|---|
| 2,206,279 | 7/1940 | Ferguson | 226/14 |
| 2,828,596 | 4/1958 | Dowty et al. | 53/386 |
| 3,022,620 | 2/1962 | Gallet | 53/137 |
| 3,165,870 | 1/1965 | Saumsiegle et al. | 53/189 |
| 3,407,567 | 10/1968 | Hudson | 53/385 |
| 3,435,584 | 4/1969 | Prechter | 53/500 |
| 3,490,195 | 1/1970 | Abramson | 53/29 |
| 3,501,893 | 3/1970 | Peterson | 53/190 |
| 3,541,758 | 11/1970 | Welborn | 53/500 |
| 3,603,059 | 9/1971 | Carnes | 53/258 |
| 3,715,857 | 2/1973 | Fronczak | 53/500 |
| 3,750,721 | 8/1973 | Hudson | 141/10 |
| 3,877,562 | 4/1975 | Shaw | 198/24 |
| 3,935,691 | 2/1976 | Broch | 53/59 |
| 4,047,362 | 9/1977 | Lister et al. | 53/189 |

*Primary Examiner*—James F. Coan

*Attorney, Agent, or Firm*—Barbara Toop D'Avanzo; Thomas R. Savoie; Daniel J. Donovan

[57] ABSTRACT

An apparatus for automatically packing discrete articles into a kraft paper bale bag includes a magazine for holding a plurality of closed flat-folded bale bags in stacked relationships, a bale picker carrying vacuum-operated suction cups for attaching to a front sidewall of a bag positioned within an exit opening of the magazine upon the picker being moved adjacent to the opening and for opening the mouth of the bag upon the picker being moved in the opposite direction, duckbills adapted to be inserted into the mouth of the bag and cooperable with clamps for clamping the sidewalls of the bag therebetween, a reciprocating pusher for executing a series of short forward strokes to assemble into a group a predetermined number of articles that are successively positioned in front of the pusher, a counter for counting the forward strokes of the pusher to count the number of articles assembled and for causing the pusher to execute a long forward stroke upon a predetermined number of articles being assembled so as to insert the group of assembled articles into the bale bag. The bale bag is partially unfolded prior to the articles being inserted therein and provides support to the articles to prevent them from tipping over during insertion. After inserting the articles into the bag, the clamps release the bags and the pusher continues its forward stroke to position the bag of articles onto a drop table that discharges the bag from the apparatus upon the pusher being retracted from the bag.

17 Claims, 10 Drawing Figures

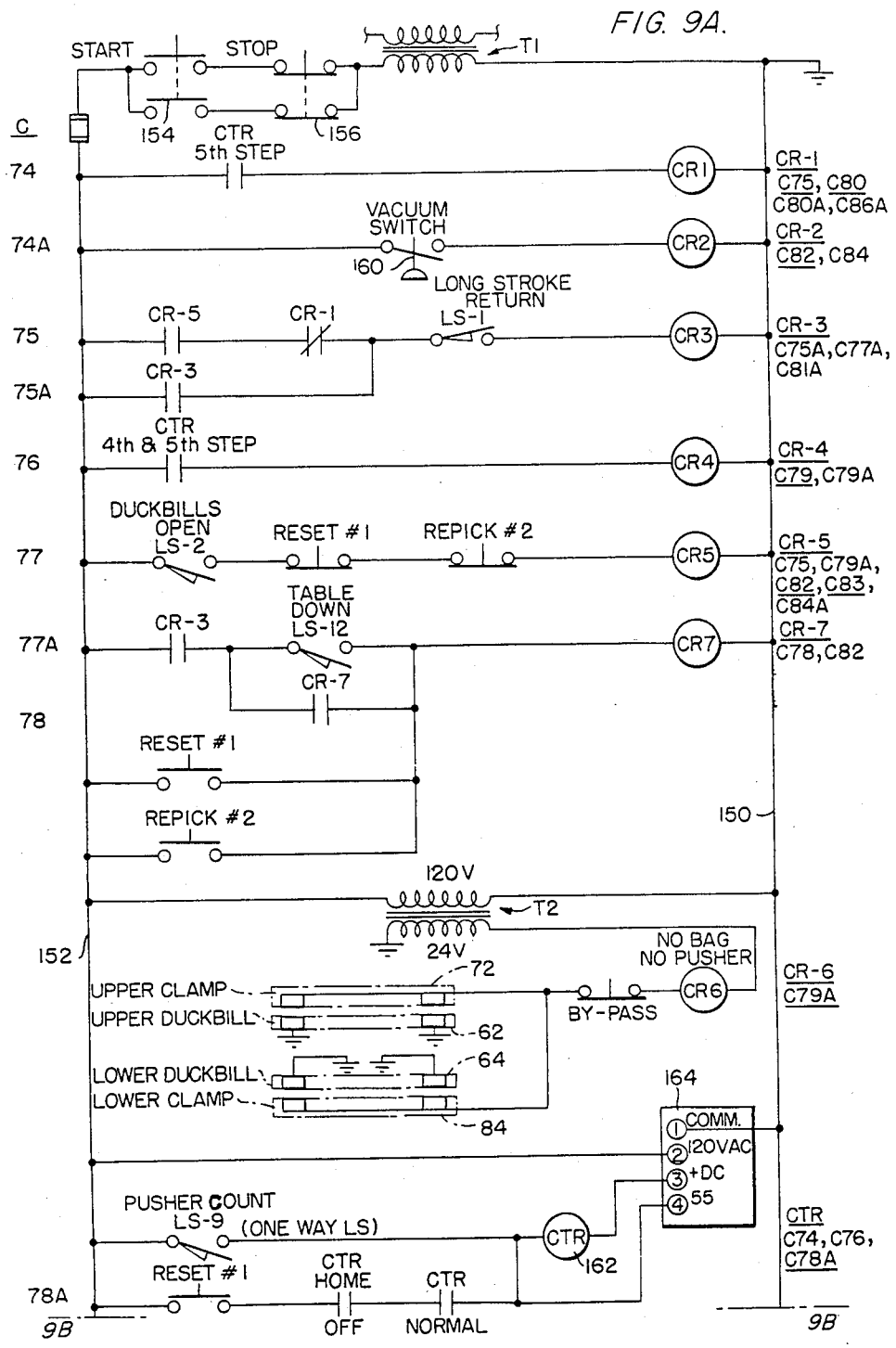
FIG. 9A.
START
STOP
T1
C
154
CTR
5th STEP
156
74
CR1
CR-1
C75, C80
C80A, C86A
VACUUM
SWITCH
74A
CR2
CR-2
C82, C84
160
LONG STROKE
RETURN
LS-1
CR-5
CR-1
75
CR3
CR-3
C75A, C77A,
C81A
CR-3
75A
CTR
4th & 5th STEP
76
CR4
CR-4
C79, C79A
DUCKBILLS
OPEN
LS-2
RESET #1
REPICK #2
77
CR5
CR-5
C75, C79A,
C82, C83,
C84A
TABLE
DOWN
LS-12
CR-3
77A
CR7
CR-7
C78, C82
CR-7
78
RESET #1
REPICK #2
150
120V
T2
152
24V
72
NO BAG
NO PUSHER
CR6
CR-6
C79A
UPPER CLAMP
UPPER DUCKBILL
BY-PASS
62
64
LOWER DUCKBILL
LOWER CLAMP
84
164
COMM.
120VAC
+DC
55
PUSHER COUNT
LS-9
(ONE WAY LS)
CTR
162
CTR
C74, C76,
C78A
RESET #1
CTR
HOME
CTR
78A
OFF
NORMAL
9B
9B

APPARATUS FOR AUTOMATICALLY PACKING ARTICLES IN A BALE BAG

BACKGROUND OF THE INVENTION

This invention relates generally to packaging apparatus and more particularly to apparatus for automatically assembling and packaging groups of articles in a bale bag.

Many industries have a need for packaging groups of articles together in bags, as for shipping purposes. In the dog food industry, for example, it is desirable to package a number of bags of dry dog food together in kraft paper bale bags. Although apparatus is known for automatically opening bags and for inserting articles therein, such apparatus has traditionally been employed for packaging bakery or paper articles in bags of polyethelene or similar materials, or have been employed for packaging pourable-type goods, e.g., sugar, grain, charcoal briquettes, etc., into bags. The problem of automatically packaging several discrete articles such as bags of dog food into kraft bale bags, which traditionally has been a tedious manual operation, has not been satisfactorily addressed. Moreover, known packaging apparatus for groups of discrete articles have typically required assembly of the articles into groups at an assembly station separate from the packaging station, which has tended to complicate and reduce the efficiency of the packaging operation. It is desirable to provide apparatus for automatically packing articles into kraft bale bags that avoids such problems, and it is to this end that the present invention is directed.

SUMMARY OF THE INVENTION

The invention provides an apparatus for automatically packing articles into a bale bag quickly and efficiently. Individual articles may be successively transferred to the apparatus directly from a continuously operating conveyor. The apparatus assembles a predetermined number of articles into a group, retrieves a closed flat-folded bale bag from a supply of such bags, partially opens the bag, packs the group of assembled articles in the bag, and deposits the packed bag onto a discharge conveyor. The same mechanism that assembles the articles also serves to insert the articles into the bag and to discharge the packed bag from the apparatus, thereby affording a rather simple packaging apparatus.

Briefly stated, in one aspect the invention affords an apparatus having an article receiving position for receiving successive articles. Sensing means senses the presence of an article at the receiving position and activates a movable pusher that is movable in a forward and backward direction for transferring the article to an assembly position. Adjacent to the assembly position, a plurality of closed flat-folded bale bags are held in stacked relationship, and means are provided for opening a bag forward of the assembly position. Means are provided for counting the forward movements of the pusher in order to count the number of articles assembled, and means responsive to the counting means and operable upon a predetermined number of articles being assembled are provided for moving the pusher forwardly beyond the assembly position to insert the assembled articles as a group into the bag.

In another aspect, the invention provides an apparatus comprising means for holding a plurality of closed flat-folded bale bags in stacked relationship, and means movable in a first direction to a position adjacent to an exit opening of the holding means for attaching to a front sidewall of the bag located at the exit opening and movable in the opposite direction for pulling the front sidewall away from the exit opening, the holding means having means for restraining a rear sidewall of the bag at the exit opening such that the mouth of the bag is opened upon the moving means moving in the opposite direction. First and second members adapted to be inserted into the mouth of the bag are provided, and clamp means cooperable with the first and second members are provided to clamp the open mouth of the bag therebetween and hold the bag in place. A reciprocating pusher means assembles a predetermined number of successive articles adjacent to the mouth of the bag and inserts the assembled articles as a group into the bag.

In accordance with more specific aspects, the bag is only partially opened prior to the group of articles being inserted therein so that as the articles are inserted the bag provides support to the articles to prevent them from tipping over. In addition to assembling the articles and packing them into the bag, the reciprocating pusher member causes the clamps holding the bag in place to release upon the articles being inserted, and moves the packed bag onto a drop table which discharges the packed bag from the apparatus. Other advantages and features of the invention will become apparent from the description that follows.

BRIEF DESCRIPTION OF THE DRAWINGS

FIGS. 9A–B are schematic views illustrating a control circuit for the apparatus of FIG. 1.

DESCRIPTION OF THE PREFERRED EMBODIMENT

Figure 1:
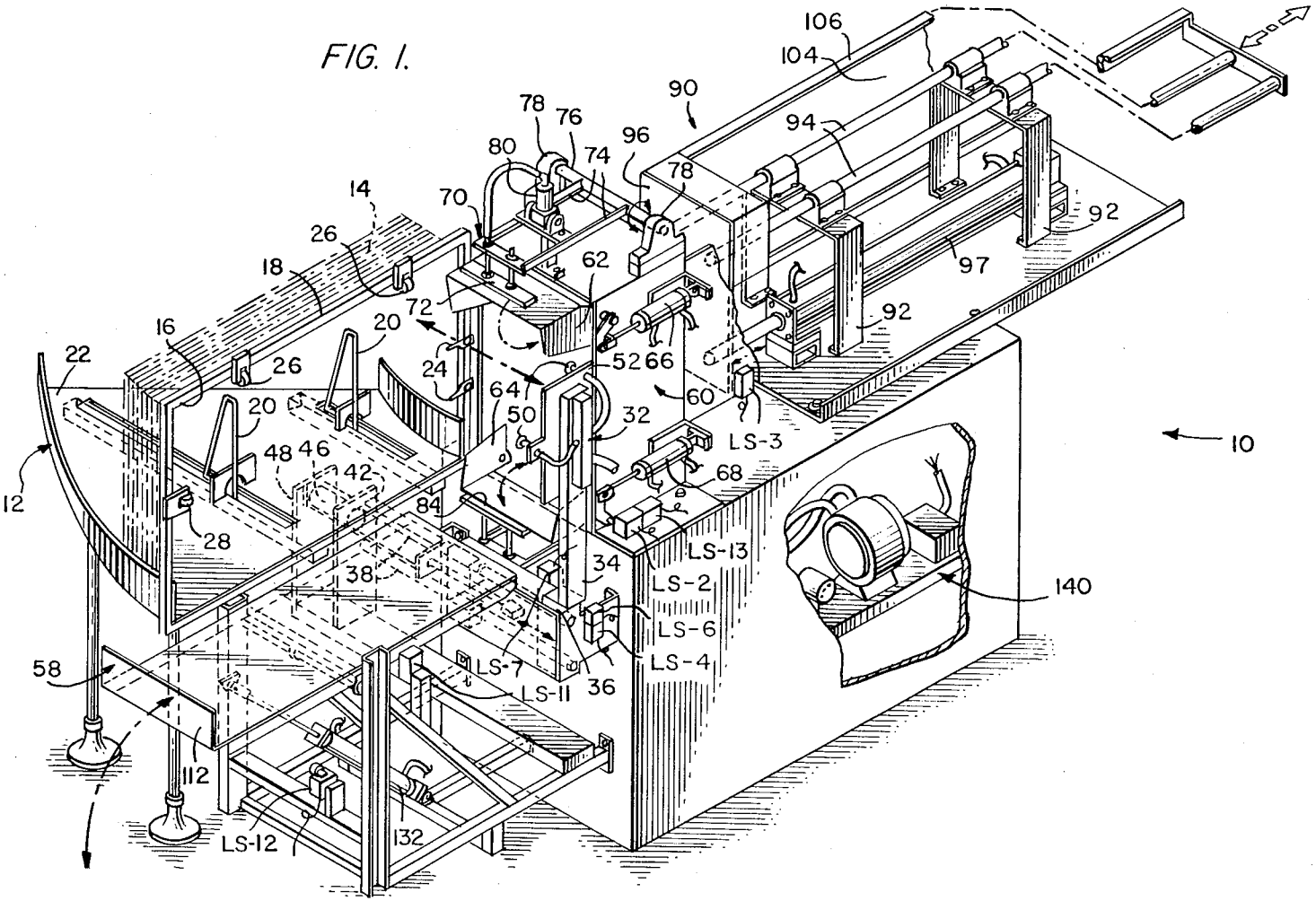
FIG. 1 is a perspective view, partially broken away, illustrating an apparatus in accordance with the invention.

FIG. 1 is a perspective view of an apparatus 10 in accordance with the invention for automatically packing articles into a bale bag. The apparatus is particularly well adapted for packing 10-pound bags of dog food into a 30 inch × 16 inch × 10 inch kraft bale bag, and will be described in that context. However, as will become apparent, this is illustrative of only one utility of the invention.

Figure 3:
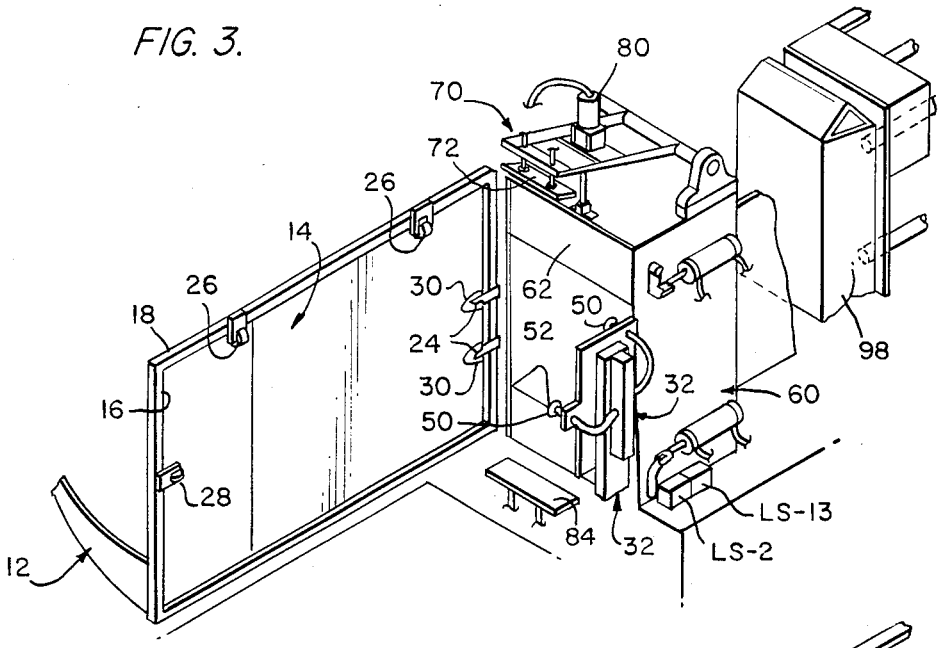
FIGS. 3–8 are a series of perspective views illustrating the operation of the apparatus of FIG. 1.

As shown in FIG. 1, apparatus 10 may generally comprise a magazine 12 for holding a plurality of closed flat-folded bale bags 14 in stacked relationship to one another adjacent to an exit opening 16 of the magazine formed by a substantially retangular frame 18, the dimensions of the exit opening being slightly greater than the dimensions of the bags. A pair of spring-loaded or pneumatic cylinder-operated members 20 may be disposed on a base portion 22 of the magazine for biasing the stack of bags toward exit opening 16. Restraining members, comprising a pair of fingers 24 positioned on a vertical right-hand (in the figure) frame member, a pair of rollers 26 positioned on a top frame member, and a roller 28 positioned on the vertical left-hand frame member project into the exit opening 16 and serve to hold the topmost bag of the stack in the plane of the exit opening, as best illustrated in FIG. 3. As is also shown in FIG. 3, the outwardly facing sidewall of the bag may be formed with slots 30 adjacent to restraining fingers 24, for a purpose to be described shortly.

Figure 4:
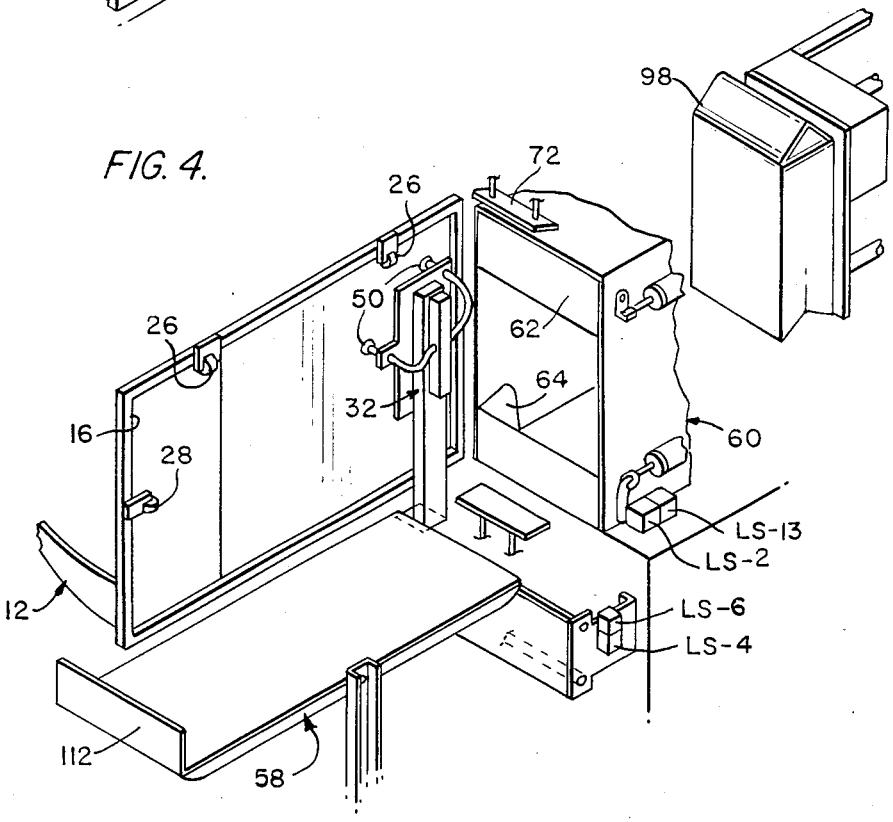

Apparatus 10 may further comprise a bag picker 32 transversely movable with respect to the longitudinal axis of the apparatus from a home position (the position illustrated in FIG. 1) to a position adjacent to the exit opening of the magazine frame, as shown in FIG. 4. The bag picker may comprise an upstanding support member 34 attached to a block 36 that is slidable on elongated rods 38 that are connected to frame support members 48 and 42. The slideable block may be connected to the piston of a pneumatic cylinder 46 that is supported by frame members 42 and 48, as shown in FIG. 1. The pneumatic cylinder controls the transverse movement of bag picker 32, in a manner to be described.

Figure 5:
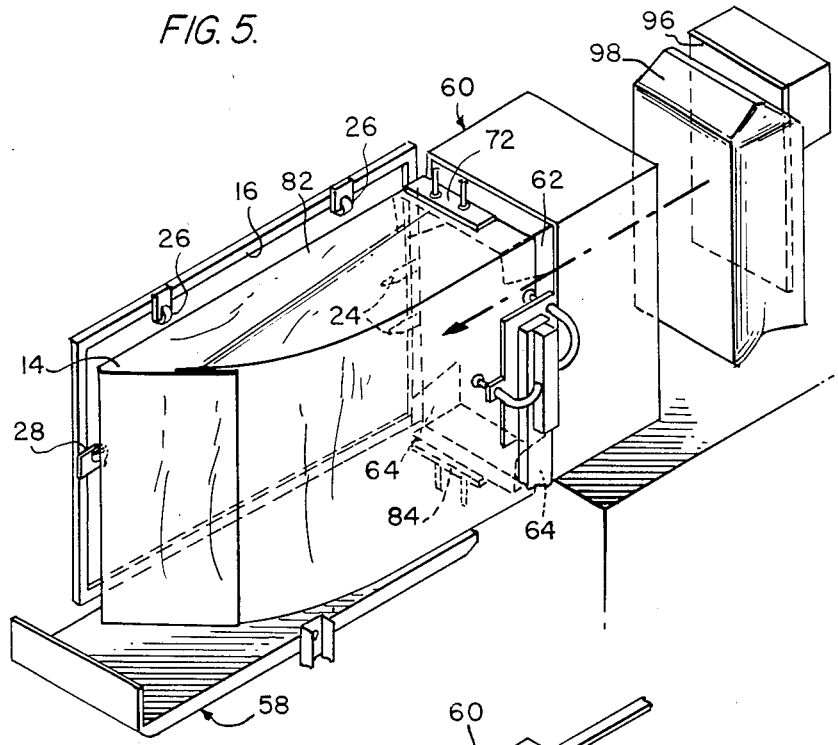

As is shown in FIG. 1, the support member 34 of the bag picker may carry a plurality of vacuum operated suction cups 50 on a plate 52. When the bag picker is moved from its home position to its position adjacent to the exit opening of the bag magazine, the suction cups adhere to the outwardly facing front sidewall of a bag positioned at the exit opening. As the bag picker returns to its home position, it pulls the front sidewall of the bag with it, slots 30 in the front sidewall allowing the front sidewall to bypass restraining fingers 24. The restraining fingers engage the rear sidewall of the bag to hold it within the plane of the exit opening as the front sidewall is pulled outwardly by the bag picker. This operation opens the mouth of the bag and causes the bag to be pulled free of rollers 26 and roller 28 so that the bag partially unfolds, as shown in FIG. 5. A drop table 58 supports the partially open bag.

As is further shown in FIG. 1, apparatus 10 may also include a substantially rectangular open frame or head assembly 60 that pivotally supports a pair of generally U-shaped upper and lower duckbill members 62 and 64, respectively. The upper and lower duckbills may be pivoted within the opening of the head assembly adjacent to the exit opening of the magazine and may be coupled as shown to pneumatic cylinders 66 and 68, respectively. The pneumatic cylinders control the movement of the duckbills between an open position (the position illustrated in FIGS. 1 and 5–7) and a closed position (the position illustrated in FIGS. 3, 4 and 8). During the previously described movement of the bag picker 32, the duckbills are in a closed position as shown in FIGS. 3 and 4. After the bag picker has opened the mouth of a bag as previously described, the duckbills pivot to their open position (in a manner to be described hereinafter) and enter the mouth of the bag. The duckbills serve to hold the mouth of the bag open and to guide the articles into a bag during a packing operation.

As is shown in FIG. 1, the top of the head assembly 60 may support an upper clamp assembly 70 comprising a flat clamp member 72 connected by a pair of arms 74 to a shaft 76 rotatably supported by a pair of pillow blocks 78. A pneumatic cylinder 80 supported between arms 74 and having a piston coupled to the top of the head assembly by a link coupling may be employed for pivoting the clamp assembly about shaft 76 to raise and lower clamp member 72. When the upper duckbill is open and clamp member 72 is lowered, i.e., closed, the upper duckbill and clamp member 72 cooperate in the manner illustrated in FIGS. 5 and 6 to clamp the top sidewall 82 of a bag therebetween. A substantially similar lower clamp assembly may provide a clamp member 84 that cooperates with the lower duckbill 64 to clamp a bottom sidewall of the bag therebetween. The clamp members and the duckbills cooperate to firmly hold the bag in place while it is being packed with articles.

Figure 2:
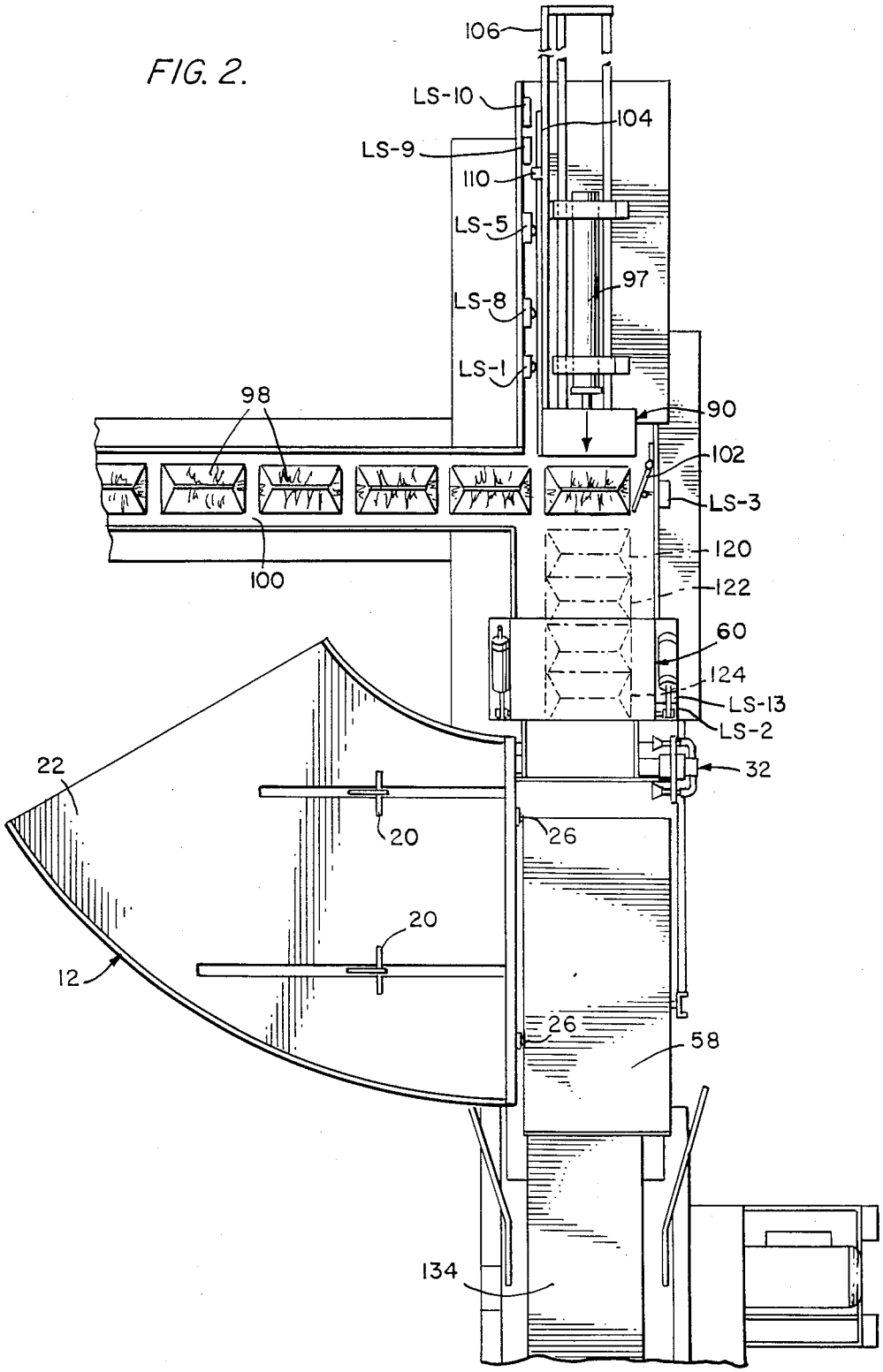
FIG. 2 is a top view illustrating schematically the apparatus of FIG. 1.

Apparatus 10 further comprises a reciprocating pusher 90 slidingly supported on a pair of frame members 92 by rods 94 and having a forward face 96. The pusher may be movable forwardly and rearwardly in the longitudinal direction of the apparatus as by a pneumatic cylinder 97. As is shown in the figures, the forward face 96 of the pusher may be substantially flat and sized to pass through the opening of the head assembly 60 when the duckbills are open to pack articles 98, such as bags of dog food, into a bale bag supported on the drop table. As is illustrated in FIG. 2, the articles may be successively supplied from the left side of the apparatus, as by an infeed conveyor belt 100, to an article receiving position directly in front of the pusher. As each article reaches the article receiving position, it activates an infeed detector, which may comprise a hinged plate 102 coupled to a switch LS-3 such as a limit switch. The hinged plate 102 may be biased in a clockwise direction (in FIG. 2) corresponding to the open position of the switch. When an article reaches the article receiving position in front of the pusher, it engages the hinged plate and closes the switch. As will be described shortly, this switch is part of the pusher control circuit and must be closed in order for the pusher to be moved forward.

As is best illustrated in FIG. 1, a portion of the left side of the pusher, i.e., the side facing the direction from which the articles are being supplied, may comprise a flat plate 104 attached to an elongated right angle support member 106. The infeed conveyor 100 preferably runs continuously, thereby causing the articles to be stacked together at the entrance to the article receiving position of the apparatus, as shown in FIG. 2. When the pusher executes a forward stroke to move forward an article in the article receiving position, plate 104 holds back the next incoming article from the infeed conveyor to prevent it from moving behind the pusher and causing jamming upon the return stroke of the pusher. Plate 104 also serves another function. It activates a pair of switches LS-9 and LS-10, which are preferably proximity-type limit switches that are activated when the plate is adjacent to them. As will be described more fully shortly, LS-9 (Pusher Count) actuates a counter that counts the forward strokes of the pusher, and LS-10 (Pusher Home) detects the pusher being in its home position (the position illustrated in FIG. 2). Accordingly, plate 104 preferably extends along the left side of the pusher from the forward end of the pusher to a position at the location of LS-10 in FIG. 2. As is also shown in FIG. 2, a tab 110 may be located on the left side of the pusher, as on plate 104, for operating lever-actuated switches LS-1 (Long Stroke Return), LS-8 (Duckbill Release) and LS-5 (Short Stroke Return) disposed adjacent to the left side of the pusher, as shown.

As will be described more fully hereinafter, the pusher executes a series of short forward strokes to assemble a predetermined number of incoming articles from the infeed conveyor into a group, and then executes a long forward stroke to pack the group of assembled articles into a partially opened bale bag positioned on the drop table and to push the packed bale bag into engagement with the upstanding lip 112 of the drop table. Switch LS-9 activates a counter as indicated above that counts the number of the forward strokes of the pusher and establishes the predetermined number of articles to be packed into a bag. Switch LS-5 is positioned such that the distance from tab 110 when the pusher is in the home position to the switch corresponds to the desired length of a short stroke, for example six inches. Until the predetermined number of articles has been assembled, switch LS-5 causes the pusher to return home after moving forward a distance corresponding to the desired length of the short stroke. The length of the short forward stroke of the pusher should be at least sufficient to move an article fed into the article receiving position from the infeed conveyor forward toward the head assembly enough to clear the article receiving position for the next incoming article, for example, to the phantom line position 120 shown in FIG. 2. Upon executing the next short forward stroke, the next article is moved to phantom line position 120 and the article previously in that position is moved forward to phantom line position 122. The pusher continues to execute short forward strokes until one less than the predetermined number, e.g., 5, of articles that are to be packed into the bale bag have been assembled in a line, as shown in FIG. 2. Preferably, the dimensions of the apparatus are such that when that number of articles has been assembled, the lead article 124 of the group of assembled articles is positioned within the head assembly 60 adjacent to the duckbills. As the pusher begins its next, i.e., fifth forward stroke, switch LS-9 increments the counter to its fifth step. This causes the Short Stroke Return switch LS-5 to be disabled (in a manner to be described) so that the pusher continues its forward motion and tab 110 passes the switch. The pusher thus moves forward, executing a long forward stroke, until the tab actuates the Long Stroke Return switch LS-1. At this point, the pusher has packed the group of five articles into the bale bag positioned on the drop table 58 and has further pushed the packed bale bag forward into engagement with lip 112 of the drop table. Prior to tab 110 actuating the Long Stroke Return switch, it actuates switch LS-8 which causes the bag clamped between the clamps and the duckbills to be released so that the bag can be pushed forward to lip 112 by the pusher.

FIGS. 3–8 illustrate a complete operating cycle of the apparatus. At the start of the cycle, the apparatus is in the position shown in FIG. 3. The bag picker 32 is in its home position, duckbills 62 and 64 are closed, and the upper and lower clamps are in a release position, the upper clamp being raised and the lower clamp being lowered so as to prevent interference with a bale bag 14 as it is pulled from magazine 12. Next, as shown in FIG. 4, the bag picker moves to a position adjacent to the exit opening of the magazine 12 and suction cups 50 attach to the outwardly facing front sidewall of the topmost bag in the magazine. The bag picker then moves back to its home position pulling the front sidewall with it, as previously described, to partially open the bag on the drop table. During this operation, the rear sidewall of the bag disengages from rollers 26 and roller 28, although it continues to be held by restraining fingers 24. The upper and lower duckbills 62 and 64, respectively, then open into the mouth of the bag, and the upper and lower clamps close to clamp the upper and lower sidewalls of the bag between clamp members 72 and 84 and the duckbills, as shown in FIG. 5.

Figure 6:
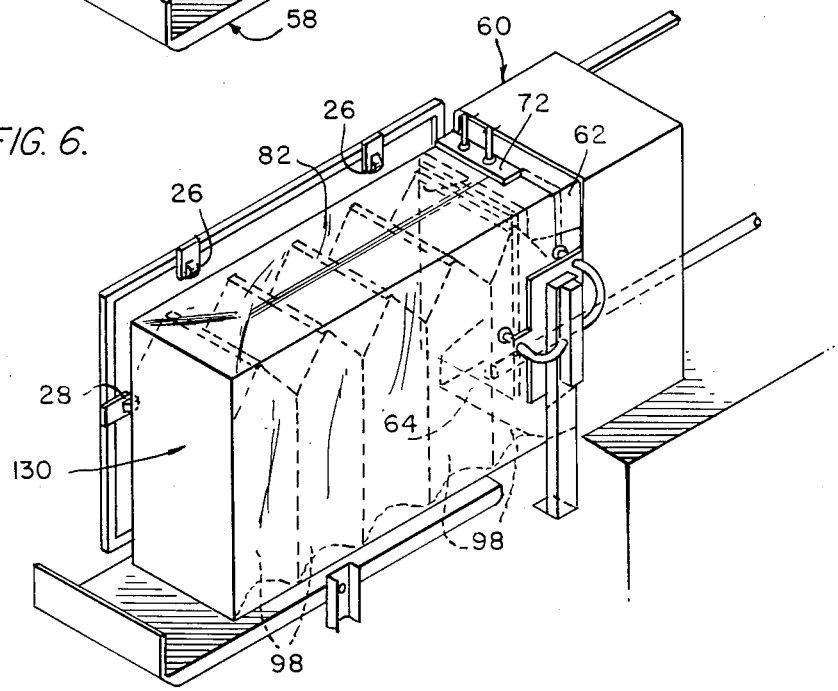
Figure 7:
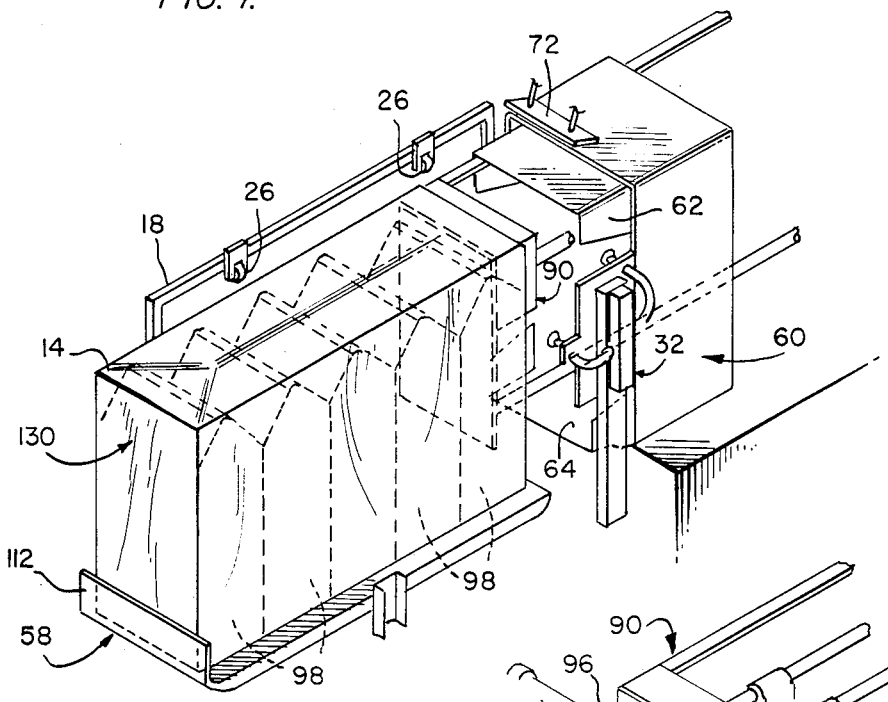
Figure 8:
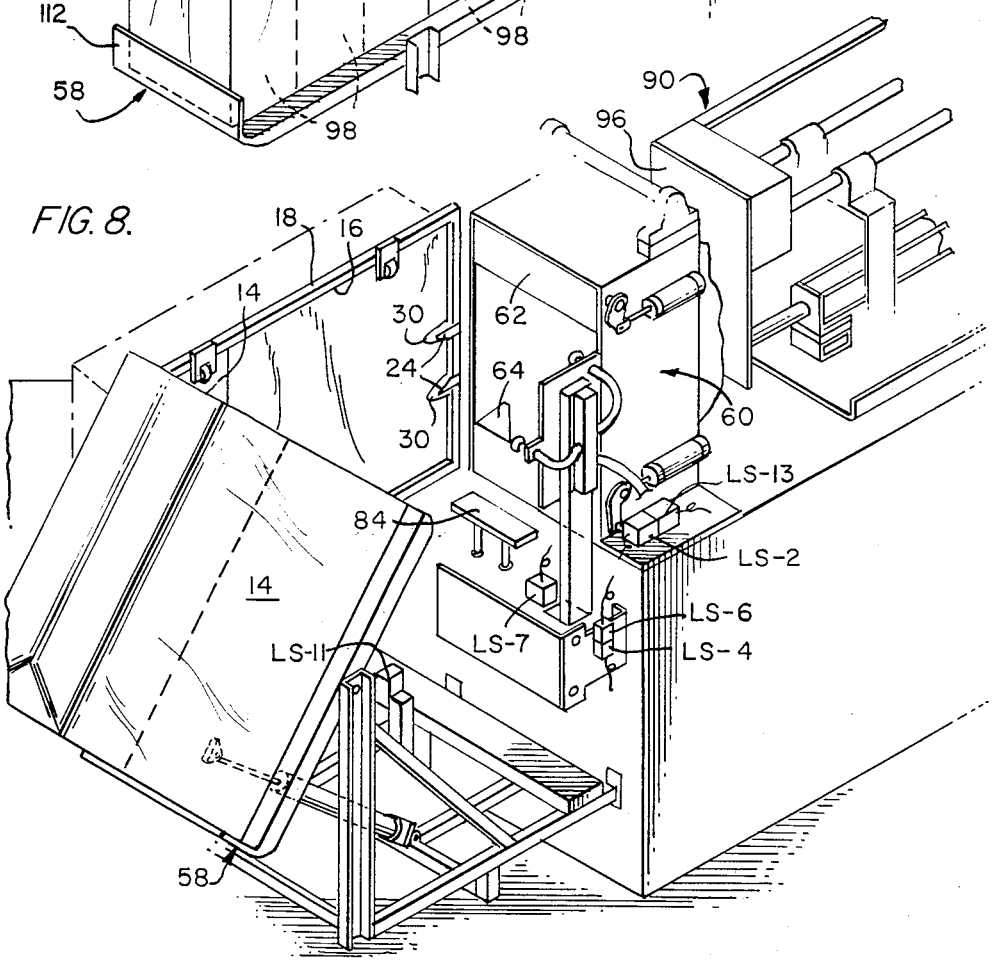

During this preceding operation, the pusher has been assembling a group of articles, in the manner described above, that are to be packed into the bag, for example, five articles. Upon the five articles being assembled, the pusher executes a long forward stroke to insert the articles as a group into the partially opened bag. As the articles are pushed into the bag, the bag opens fully (as shown in FIG. 6). It is an advantage of the invention that the bag is only partially opened prior to the articles being inserted therein, since the partially opened bag tends to support the leading article of the group as it is inserted to prevent the leading article from tipping over. As the leading article reaches the bottom 130 of the bag, as shown in FIG. 6, the clamps and the duckbills release the upper and lower sidewalls of the bag so that as the pusher continues its forward stroke the packed bag is moved forwardly into engagement with lip 112 of the drop table, as shown in FIG. 7. The pusher then executes a return stroke, and a pneumatic cylinder 132 (see FIG. 1) is actuated to cause the drop table to pivot (in the manner illustrated in FIG. 8) to discharge the packed bag from the apparatus. As illustrated in FIG. 2, a discharge conveyor 134 may be located adjacent to the drop table so that the packed bag may be deposited thereon. The time for one cycle of the apparatus is of the order of 10 seconds.

Figure 9B:
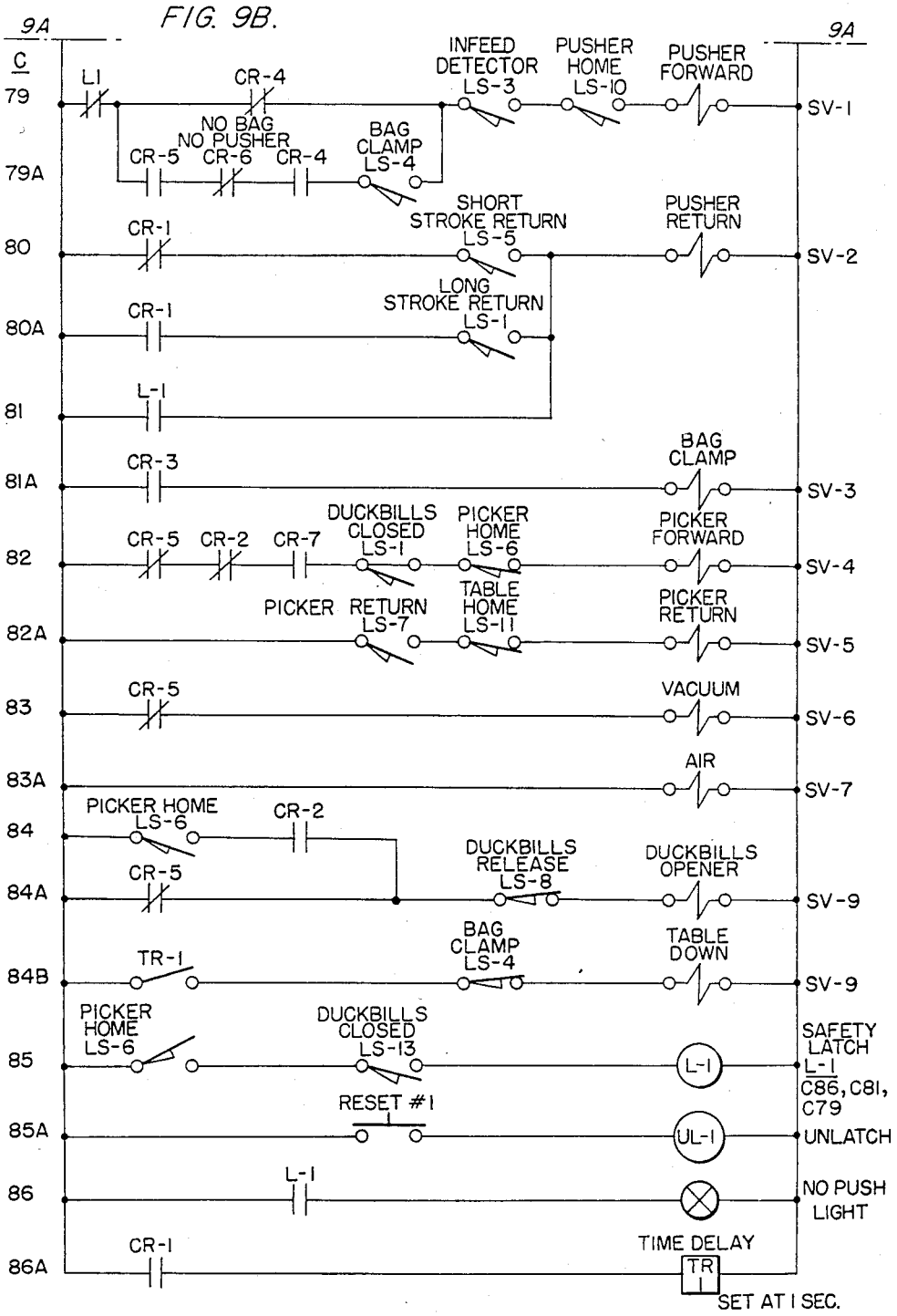

The apparatus may employ pneumatic actuators controlled by solenoid actuated valves for its operation. For this purpose, the apparatus may include a conventional pneumatic, e.g., air, system designated generally by the reference numeral 140 in FIG. 1, and may employ conventional pneumatic actuators controlled in a well-known manner by solenoid-operated spool valves. FIGS. 9A–B are a ladder diagram illustrating a preferred form of a control circuit for the apparatus. Prior to describing the control circuit, the conventions employed in FIGS. 9A–B will first be described.

As shown in FIG. 9A, AC power may be derived from the secondary of a transformer T1, one side of which is grounded and connected to a ground bus 150, and the other side of which is connected to a power bus 152 through start and stop switches 154 and 156, respectively. The numbers C-74 through C-86A along the left side of the figures (adjacent to the power bus 152) designate individual circuits connected between the power bus and the ground bus. The circles containing the legends CR-1 through CR-7 represent control relays. The contacts of the control relays are represented in conventional manner by a pair of short vertical lines to represent normally open contacts and by a pair of short vertical lines with a diagonal line therethrough to represent normally closed contacts. The control relay with which each pair of contacts is associated is indicated above the contacts, and the state of each pair of contacts, i.e., closed or open, is shown for the unenergized state of the corresponding control relay. Along the right side of the figures adjacent to each circuit, the designators are given for the circuits in which the contacts of the control relay of that circuit are used. Circuit designators that are underlined indicate that the control relay contacts in such circuits are normally closed and circuit designators that are not underlined indicate that the contacts are normally open. The designators SV-1 through SV-9 in circuits C-79 through C-84B refer to spool valves to which the solenoids in their corresponding circuits pertain. Spool valves SV-1 and SV-2 control pneumatic actuator 97; SV-3 controls actuator 80; SV-4 and SV-5 control actuator 46; SV-8 controls actuators 66 and 68; and SV-9 controls actuator 132. SV-6 and SV-7 respectively control the vacuum and air systems illustrated generally at 140 in FIG. 1.

A number of the circuits of the control circuit of FIGS. 9A–B are controlled by the previously described switches LS-1, LS-3, LS-5, LS-8, LS-9 and LS-10 in a manner which will be described shortly. In addition, the apparatus may include a plurality of additional switches for control purposes, and these will be briefly described by reference to FIG. 1 prior to describing the operation of the control circuit.

Referring to FIG. 1, a switch LS-2 (Duckbills Open) and a switch LS-13 (Duckbills Closed) may be disposed adjacent to pneumatic cylinder 68 and coupled to the actuating mechanism for the lower duckbill 64 so as to be actuated upon the duckbills being opened and closed. A pair of switches LS-4 (Bag Clamp) and LS-6 (Picker Home) may be disposed on a support bracket for picker assembly 32. LS-4 may be coupled to the clamps and may provide two sets of contacts, one set which is closed when the clamps are closed and one set which is closed when the clamps are opened. LS-6 detects the picker assembly being in the home position, and may provide three sets of contacts, two of which are closed when the picker is home and one of which is open. Another switch LS-7 (Picker Return) may be coupled to the picker assembly and arranged to be actuated upon the picker moving away from home position. A further pair of switches, LS-11 (Table Home) and LS-12 (Table Down) may be associated with drop table 58 for indicating, respectively, the drop table being in its home position and in its down position.

In addition, as shown in FIGS. 9A–B, the apparatus may further include a vacuum switch 160 (circuit C74A) that is arranged to be closed upon the suction cups 50 attaching to a sidewall of a bag and a vacuum being pulled. Switches may also be included for preventing operation of the pusher if a bag is not properly positioned between the duckbills and the clamps. As indicated in FIG. 9A, the upper and lower duckbills may be connected to electrical ground, and the upper and lower clamp members 72 and 84 may be formed with electrical contacts on their surface. The contacts of the clamp members may be connected in parallel through control relay CR-6 to the low voltage (24 volts, for example) secondary of a transformer T2. When the duckbills are opened and the clamps are closed with the top and bottom sidewalls of a bag positioned therebetween, the sidewalls of the bag electrically insulate the electrical contacts of the clamp from the duckbills. However, if the electrical contacts of either clamp engage their associated duckbill, as where the picker fails to open a bag properly on the drop table, a current path from the transformer secondary to ground will be established and CR-6 will be energized to prevent operation of the pusher, as will be described.

As previously described, the apparatus assembles and packs a predetermined number of articles in bags by employing a counter for counting the number of forward strokes of the pusher. For this purpose, a stepping-type counter (CTR) 162 (see FIG. 9A) may be employed. As shown, the counter may have its own DC power supply 164 and may be connected to the Pusher Count switch LS-9, as illustrated. Each time the pusher begins a forward stroke, LS-9 is actuated and the counter is incremented. The circuit illustrated in C78A is a reset circuit for the counter.

In the explanation which follows, it will be assumed that it is desired to pack five articles into each bale bag. However, as will become apparent, the invention is readily adaptable to packing a fewer or greater number of articles into bags.

In circuit C74 of FIG. 9A control relay CR-1 is in series with a pair of normally open contacts that are closed upon the counter (CTR) reaching the fifth step. As indicated to the right of this circuit, CR-1 provides four sets of contacts for circuits C-75, C-80, C-80A and C-86A, the contacts in circuits C-75 and C-80 being normally closed. Upon the counter reaching the fifth step and CR-1 being energized, the normally closed contacts in circuit C-80 (in series with Short Stroke Return switch LS-5) are opened and the normally opened contacts in circuit C-80A (in series with the Long Stroke Return switch LS-1) are closed. This disables the Short Stroke Return switch so that the pusher can execute a long stroke and enables the Long Stroke Return switch to cause the pusher to return to home position.

The normally open contacts in circuit C-86A are also closed upon CR-1 being energized, causing a time delay relay TR-1 having a time delay of 1 second, for example, to be energized. The normally open contacts of TR-1 are in circuit C-84B (as indicated to the right of the time delay relay) and are in series with one set of the contacts of LS-4 and the Table Down solenoid of spool valve SV-9. When the contacts of TR-1 and switch LS-4 are both in the closed position (LS-4 being closed when the clamp is opened) pneumatic cylinder 132 is actuated to cause the drop table to move down to deposit a packed bag onto a discharge conveyor, as previously described. The one second delay provided by TR-1 is to afford sufficient time for the pusher to push the packed bag to lip 112 of the table and to retract out of the bag.

When vacuum switch 160 of circuit C-74A is closed, CR-2 is energized to disable the Picker Forward solenoid of spool valve SV-4 in circuit C-82 (so the picker can return home) and to enable the Duckbill Opener solenoid of SV-8 in circuit C-84 to be operated upon the Duckbill Release switch LS-8 closing.

The Long Stroke Return switch LS-1 provides two sets of contacts, one set in circuit C-75 and the other in circuit C-80A. The contacts in C-75 are normally closed until the pusher executes a long stroke and actuates LS-1. When the duckbills are open, switch LS-2 in circuit C-77 is closed, energizing CR-5 and closing the normally open contacts of CR-5 in circuit C-75. This energizes CR-3, which in turn energizes the Bag Clamp solenoid of SV-3 in circuit C-81A. When the contacts of LS-1 in circuit C-75 open, CR-3 and the Bag Clamp solenoid are de-energized.

Control relay CR-4 is energized during the fourth and fifth steps of the counter to open the normally closed set of contacts of CR-4 in circuit C-79 and to close the normally open set of contacts in circuit C-79A, which controls the Pusher Forward solenoid of spool valve SV-1. When the pusher is home, LS-10 in circuit C-79 is closed, and upon an article being received in the article receiving position, the Infeed Detector switch LS-3 is closed, causing the pusher to execute a forward stroke. During the first three steps of the counter, circuit C-79 enables the pusher to assemble articles as previously described. By the fourth step, the picker assembly should have opened the mouth of a bag on the drop table forward of the head assembly and the bag should have been clamped between the duckbills and the clamps. During the fourth and fifth steps of the counter, circuit C-79A controls the forward motion of the pusher, which is permitted only if the Bag Clamp switch LS-4 is closed indicating that the clamps are closed, relay contacts CR-6 are closed indicating that a bag is properly positioned between the clamps, and relay contacts CR-5 are closed indicating that the duckbills are open. Circuit C-79A prevents the pusher from moving forward upon the fourth step of the counter if either the duckbills are closed, the the bag clamp is open, or a bag is not in properly positioned between the duckbills and the clamps. The normally closed contacts L1 in circuit C-79 of the safety latch L-1 (circuit C-85) are also opened if either the duckbills are closed or the picker is not in home position to prevent the forward movement of the pusher. Upon the safety latch L-1 being actuated, the No Pusher Light of circuit C-85A is also illuminated. The Reset #1 switch of circuit C-85A controls an unlatch switch UL-1 to reset the apparatus.

Circuits C-82 and C-82A control the forward and return motions, respectively, of the picker. Circuit C-82 allows the picker to move forward to transfer a bag from the magazine in the manner previously described only when the duckbills are closed (LS-13 is closed) and the picker is at its home position (LS-6 is closed). Circuit C-82A allows the picker to return to home position only when the table is in home position (LS-11 is closed) and the Picker Return switch LS-7 is closed (indicating that the picker is not already in home position).

Circuit C-84 controls the Duckbill Opener solenoid of SV-8 to open the duckbills upon the Duckbill Release switch LS-8 being closed during the long forward stroke of the pusher. As previously described, LS-8 is positioned with respect to the pusher tab such that it is activated just after the articles have been packed into the bag. This de-energizes the Duckbill Opener solenoid to release the bag so that it may be pushed to the lip of the drop table.

Although the control circuit of FIGS. 9A–B employs AC control relays, it may be appreciated from the foregoing that the apparatus of the invention may also be controlled using DC control relays, or solid state integrated circuits. Furthermore, although the preferred embodiment of the invention employs pneumatic actuators, it will also be apparent that the invention may employ other types of actuators.

While a preferred embodiment of the invention has been shown and described, it will be apparent to those skilled in the art that changes can be made in the embodiment without departing from the principles and spirit of the invention, the scope of which is defined in the appended claims.

We claim:

1. An apparatus for automatically packing articles into a bale bag comprising:

an article receiving position for receiving successive articles;

sensing means for sensing the presence of an article at the article receiving position and for activating a movable pusher that is movable in a forward and backward direction for moving said article forward to an assembly position;

means forward of the assembly position for holding a plurality of closed flat-folded bale bags in stacked relationship;

means for opening a bag from the bag holding means forward of the assembly position, said means comprising means for partially opening the bag such that the partially opened bag supports the assembled articles as they are inserted into the bag to prevent the articles from tipping over;

means for counting the number of forward movements of the pusher to count the number of articles assembled; and, means responsive to the counting means and operable upon a predetermined number of articles being assembled for moving the pusher forwardly beyond the assembly position to insert the assembled articles as a group into the bag.

2. The apparatus of claim 1, wherein the opening means comprises first and second opening members movable between a closed position and an open position at which the members are inserted into the bag, and first and second clamps cooperable with the first and second members, respectively, for clamping a sidewall of a bag therebetween to hold the bag in place as the articles are inserted into the bag, and which further comprises means for detecting the absence of an open bag forward of the assembly position and for preventing the pusher from moving forward to insert the assembled articles into a bag.

3. The apparatus of claim 1 further comprising first return means responsive to the pusher moving forward from a home position a first predetermined distance corresponding to the distance between the article receiving position and the assembly position for returning the pusher to home position, the means responsive to the counting means including means for disabling said first return means upon the counting means reaching said predetermined number, and second return means responsive to the pusher moving forward from home position a second predetermined distance greater than the first predetermined distance for returning the pusher to home position.

4. The apparatus of claim 3, wherein the first and second return means comprise first and second switches disposed adjacent to the pusher and adapted to be respectively actuated by the pusher upon the pusher moving said first and second predetermined distances.

5. The apparatus of claim 4, wherein said second predetermined distance is sufficient to insert the articles into the bag and to move the bag and the inserted articles forwardly on means for discharging the bag of articles from the apparatus.

6. The apparatus of claim 5, wherein the discharging means comprises a pivoted drop table for supporting the bag horizontally as articles are inserted therein, and means for pivoting the table to a vertical position to deposit the bag of articles onto a discharge conveyor.

7. The apparatus of claim 6, wherein the pivoting means is operable to pivot the table upon the pusher being retracted from the bag after moving said second predetermined distance.

8. The apparatus of claim 2, wherein the detecting means comprises switch means adapted to be actuated upon a clamp engaging an opening member without a bag sidewall therebetween.

9. The apparatus of claim 1, wherein the opening means comprises first and second opening members movable between a closed position and an open position at which the members are inserted into the bag, and first and second clamps cooperate with the first and second member, respectively, for clamping a sidewall of a bag therebetween to hold the bag in place as the articles are inserted into the bag, and which further comprises means responsive to the counting means for preventing forward movement of the pusher to insert the articles into the bag when the first and second opening members are in closed position.

10. An apparatus for automatically packing articles into a bale bag comprising:

means for holding a plurality of closed flat-folded bale bags in stacked relationship;

means movable in a first direction to a position adjacent to an exit opening of the holding means for attaching to a front sidewall of a bag located at the exit opening and movable in the opposite direction for pulling the front sidewall away from the exit opening, the holding means having means for restraining a rear sidewall of the bag at the exit opening such that a mouth of the bag is opened upon the moving means moving in said opposite direction, said restraining means comprising fingers projecting into the exact opening, the front sidewall of the bag being slotted adjacent to the fingers to enable the front sidewall to bypass the fingers upon the attaching means moving in said opposite direction;

first and second members adapted to be inserted into the mouth of the bag;

clamp means cooperable with the first and second members for clamping the bag therebetween and for holding the bag in place; and movable pusher means for assembling a predetermined number of successive articles adjacent to the mouth of the bag and for inserting the assembled articles as a group into the bag.

11. An apparatus for automatically packing articles into a bale bag comprising:

means for holding a plurality of closed flat-folded bale bags in stacked relationship;

means movable in a first direction to a position adjacent to an exit opening of the holding means for attaching to a front sidewall of a bag located at the exit opening and movable in the opposite direction for pulling the front sidewall away from the exit opening, the holding means having means for restraining a rear sidewall of the bag at the exit opening such that a mouth of the bag is opened upon the moving means moving in said opposite direction;

first and second members adapted to be inserted into the mouth of the bag;

clamp means cooperable with the first and second members for clamping the bag therebetween and for holding the bag in place;

movable pusher means for assembling a predetermined number of successive articles adjacent to the mouth of the bag and for inserting the assembled articles as a group into the bag; and means for positioning successive articles in front of the pusher means, means for causing the pusher means to execute a short forward stroke to move each article forward toward the first and second members, counter means for counting the number of forward strokes of the pusher means, and means responsive to the counter means counting a predetermined number of forward strokes for causing the pusher means to execute a long forward stroke to insert the group of articles into the bag.

12. The apparatus of claim 11 further comprising means for detecting the absence of a bag between the first and second members and the clamp means and for inhibiting the operation of the pusher means.

13. The apparatus of claim 18, wherein the detecting means is operative upon the counter means reaching a predetermined count for preventing the pusher means from executing said long forward stroke.

14. The apparatus of claim 11 further comprising means responsive to the pusher means executing said long forward stroke for releasing the clamp means to enable the pusher means to move the bag of articles forwardly away from the first and second members so as to position the bag of articles upon means for discharging the bag from the apparatus.

15. The apparatus of claim 14, wherein the discharging means comprises a pivoted drop table for supporting the bag horizontally as it is packed with articles, and means for pivoting the table to a vertical position following the long forward stroke of the pusher means so as to discharge the bag of articles from the apparatus.

16. The apparatus of claim 11 further comprising first switch means for detecting the pusher means being in a fully retracted home position, and second switch means adapted to be actuated upon the pusher means moving forward from the home position for incrementing the counter means, and wherein said means for causing the pusher to execute a short forward stroke comprises third switch means adapted to be actuated upon the pusher moving forward from the home position a distance corresponding to the short forward stroke and for controlling means for moving the pusher means so as to cause the pusher means to return to home position, and wherein the means for causing the pusher means to execute a long forward stroke comprises fourth switch means adapted to be actuated upon the pusher means moving from the home position another distance corresponding to the long forward stroke for controlling the moving means for returning the pusher means to home position, the third switch means being disabled upon the counter means reaching said predetermined count.

17. The apparatus of claim 11, wherein the first and second members are pivotally supported within a frame for movement between a closed position at which they are substantially within the frame and an open position at which they are inserted into the mouth of the bag, and wherein the apparatus further comprises means responsive to the counter means attaining said predetermined count and the first and second members being in closed position for preventing the long forward stroke of the pusher means.

* * * * *